US009901183B2

(12) United States Patent
Shih

(10) Patent No.: US 9,901,183 B2
(45) Date of Patent: Feb. 27, 2018

(54) SUPPORTING FRAME OF ELECTRIC BED

(71) Applicant: Chuan-Hang Shih, Lu-Kang Town (TW)

(72) Inventor: Chuan-Hang Shih, Lu-Kang Town (TW)

( * ) Notice: Subject to any disclaimer, the term of this patent is extended or adjusted under 35 U.S.C. 154(b) by 268 days.

(21) Appl. No.: 14/932,712

(22) Filed: Nov. 4, 2015

(65) Prior Publication Data

US 2017/0027333 A1 Feb. 2, 2017

(30) Foreign Application Priority Data

Jul. 30, 2015 (TW) ..... 104212277 U

(51) Int. Cl.
*A47C 19/02* (2006.01)
*A47C 19/04* (2006.01)
*A61G 7/015* (2006.01)

(52) U.S. Cl.
CPC ..... *A47C 19/021* (2013.01); *A47C 19/04* (2013.01); *A61G 7/015* (2013.01)

(58) Field of Classification Search
CPC ..... A47C 19/04; A47C 19/045; A47C 19/021
See application file for complete search history.

(56) References Cited

U.S. PATENT DOCUMENTS 2,887,691 A * 5/1959 Talarico ..... A61G 7/005 5/145
5,245,718 A * 9/1993 Krauska ..... A61G 7/015 5/611
5,566,412 A * 10/1996 Arnold ..... A47C 19/045 5/509.1
6,079,065 A * 6/2000 Luff ..... A47C 20/041 5/613
2013/0276234 A1* 10/2013 Rawls-Meehan ..... A61G 7/015 5/618
2014/0352068 A1* 12/2014 Xu ..... A47C 20/041 5/616

* cited by examiner

*Primary Examiner* — Robert G Santos
*Assistant Examiner* — Rahib T Zaman
(74) *Attorney, Agent, or Firm* — Muncy, Geissler, Olds & Lowe, P.C.

(57) ABSTRACT

A supporting frame of an electric bed, which is used to be connected with a lateral board, includes a base, a supporting portion disposed on the base, and an extended supporter. At least a part of the supporting portion is movable relative to the base. The lateral board is adjacent to the edge of the supporting portion. The extended supporter has a transverse portion extended from the base toward the lateral board, and a connecting portion located at a free end of the transverse portion. The transverse portion and the supporting portion have a distance therebetween. The connecting portion is used to be connected with the lateral board, so that the lateral board of the bed frame is fixed by being connected with the base by the extended supporter, and the user is prevented from being pinched.

2 Claims, 4 Drawing Sheets

SUPPORTING FRAME OF ELECTRIC BED

BACKGROUND

1. Technical Field

The present disclosure relates to a supporting frame, and particularly, to a supporting frame of an electric bed.

2. Description of Related Art

At present, the commercially available electric beds not only have a part changeable in angle or direction, but also provide a vibratory massage function for comforting and relaxing the user. The user or the manufacturer may further install a bed frame surrounding the electric bed to increase the usage security, reduce the probability of object invasion, and also achieve the performance in overall styling.

However, most of the extra bed frames are movable relative to the electric bed, that is, the bed frame and the electric bed are not fixed with each other and have a distance therebetween. If a child puts hands or feet into the space between the bed frame and the electric bed or a pet runs into the space by accident, and at the same time one side of the bed frame receives an external force, such as an unknowing person's pushing force, thereby moved toward the electric bed, the child or the pet may be pinched between the electric bed and the bed frame and get hurt.

SUMMARY

In view of the above-noted problems, an objective of the present disclosure is to provide a supporting frame of an electric bed, which is connected with a bed frame to disable the bed frame from being moved relative to the electric bed, and prevent the user from being pinched between the bed frame and a movable supporting portion or a base.

To achieve the above objective, the present disclosure provides a supporting frame of an electric bed, which is adapted to be connected with a lateral board of a bed frame, and includes a base, a supporting portion disposed on the base, and an extended supporter. At least one part of the supporting portion is movable relative to the base, and the lateral board is located adjacent to the edge of the supporting portion. The extended supporter has a transverse portion extended from the base toward the lateral board, and a connecting portion located at a free end of the transverse portion. The transverse portion and the supporting portion have a distance therebetween. The connecting portion is adapted to be connected with the lateral board.

Because the extended supporter connects the base and the lateral board, the lateral board is fixed effectively, so that the lateral board of the bed frame is prevented from being moved toward the base of the electric bed and the user is prevented from the danger of being pinched. In addition, because the transverse portion of the extended supporter and the supporting portion have the distance therebetween, the user is prevented from getting hurt by being pinched between the supporting portion and the extended supporter.

DESCRIPTION OF THE EXEMPLARY EMBODIMENTS

Figure 1:
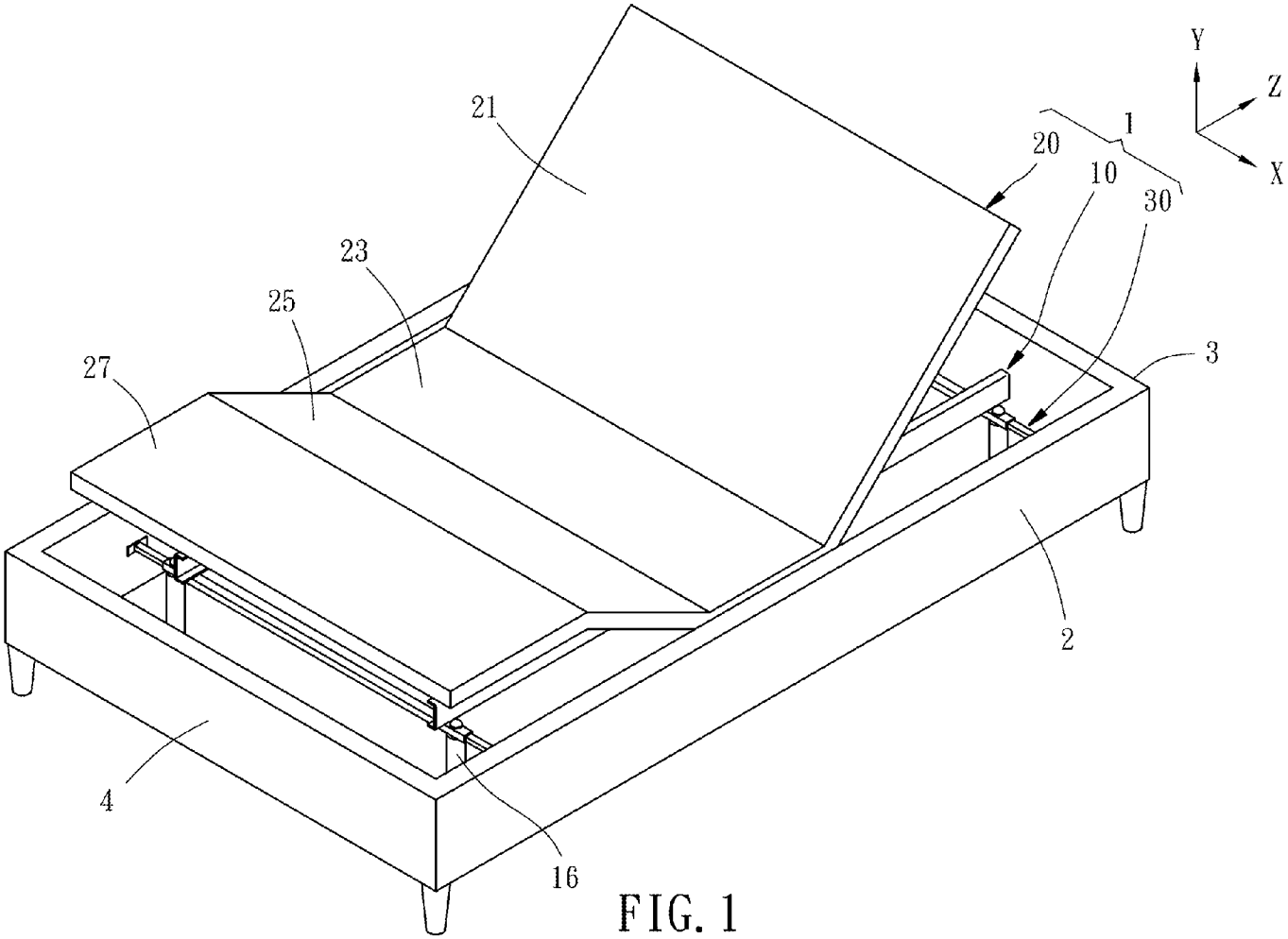
FIG. 1 is a perspective view of a first embodiment of the present disclosure.
Figure 2:
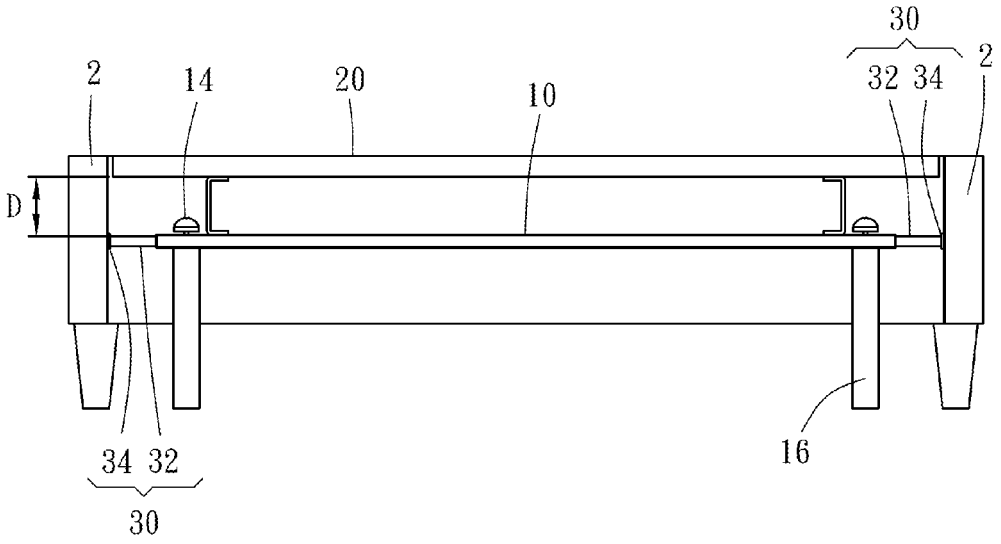
FIG. 2 is a sectional view of the first embodiment of the present disclosure.
Figure 3:
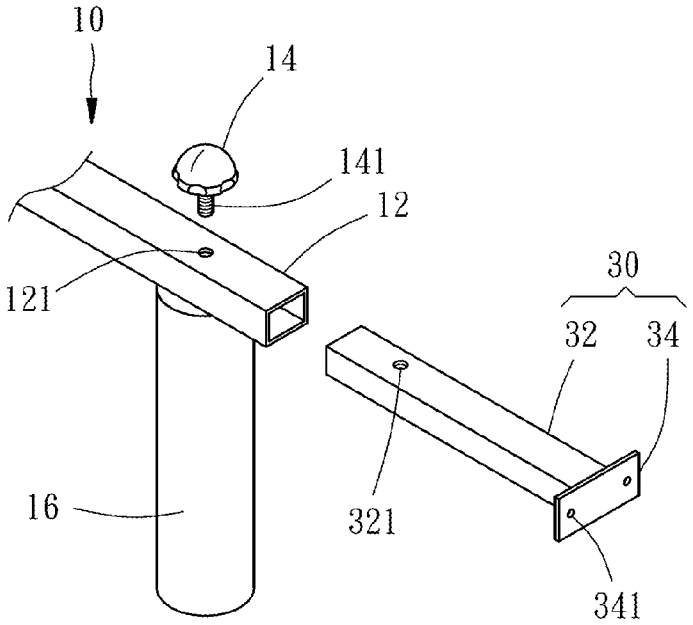
FIG. 3 is an exploded perspective view of a part of the first embodiment of the present disclosure.

Referring to FIGS. 1-3, a supporting frame 1 of an electric bed according to a first embodiment of the present disclosure is adapted to be connected with two lateral boards 2, a front board 3 and a rear board 4. The supporting frame 1 of the electric bed includes a base 10, a supporting portion 20 and four extended supporters 30. In the following illustrations of the present disclosure, the right side of the supporting frame 1 of the electric bed is defined in the x-direction shown in FIG. 1 and the left side of the supporting frame 1 is defined in the direction opposite to the x-direction; the top side of the supporting frame 1 of the electric bed is defined in the y-direction shown in FIG. 1, and the bottom side of the supporting frame 1 is defined in the direction opposite to the y-direction; the front side of the supporting frame 1 of the electric bed is defined in the z-direction shown in FIG. 1, and the rear side of the supporting frame 1 is defined in the direction opposite to the z-direction. In this embodiment, the two lateral boards 2 are located at the left and right sides of the supporting frame 1 of the electric bed respectively, and form a bed frame in cooperation with the front board 3 and the rear board 4. However, the structure of the bed frame can be modified in other embodiments according to the practical situations. For example, the bed frame can have no such front board 3 located at the front side of the supporting frame 1 of the electric bed, so that the head portion of the electric bed can be abutted against a wall directly.

As shown in FIG. 1 the base 10 has four support legs 16 extended downwardly, and the supporting portion 20 is disposed on the base 10 and has a back plate 21, a hip plate 23, an upper leg plate 25 and a lower leg plate 27. In this embodiment, the back plate 21 and the upper leg plate 25 can be swung upwardly or downwardly relative to the base 10, and the lower leg plate 27 can be moved upwardly or downwardly following the upper leg plate 25. When the supporting portion 20 is arranged to be flat for the user to lie down flat thereon, the lateral boards 2, the front board 3 and the rear board 4 are adjacent to the edges at the left, right, front and rear sides of the supporting portion 20, respectively. Specifically speaking, the two lateral boards 2 cover the left and right sides of the supporting portion 20, and the front board 3 and the rear board 4 cover the front and rear sides of the supporting portion 20. In other embodiments, the supporting portion 20 may cover the top sides of the lateral boards 2, the front board 3 and the rear board 4. In any case, the lateral boards 2, the front board 3 and the rear board 4 are positioned adjacent to the edges of the supporting portion 20.

As shown in FIGS. 1-2, two of the four extended supporters 30 of the supporting frame 1 of the electric bed are disposed at the left side of the base 10, and the other two extended supporters 30 are disposed at the right side of the base 10. Each extended supporter 30 has a transverse portion 32 extended from the base 10 toward the adjacent lateral board 2, and a connecting portion 34 located at a free end of the transverse portion 32 to be connected with the adjacent lateral board 2. Each transverse portion 32 and the supporting portion 20 have a distance D therebetween. As shown in FIG. 3, in each extended supporter 30 of this embodiment, the transverse portion 32 is connected with a central part of the connecting portion 34, so that each extended supporter 30 is T-shaped. The base 10 has two transverse pipes 12, each has two ends, which are sleeved onto the transverse portions 32 respectively, so that at least a part of each transverse portion 32 is received in the transverse pipe 12. Each transverse pipe 12 has a first positioning hole 121 located at the top thereof, and each transverse portion 32 has a second positioning hole 321 located at the top thereof correspondingly to a first positioning hole. Each first positioning hole 121 and the second positioning hole 321 corresponding thereto are passed by a positioning member 14, so that the transverse pipes 12 are fastened with the extended supporters 30. Each positioning member 14 has a threaded rod 141. Each first positioning hole 121 is a through hole 341 passed by the threaded rod 141 of the positioning member 14, and each second positioning hole 321 is a threaded hole screwed with the threaded rod 141 of the positioning member 14. Each connecting portion 34 has two through holes 341 which are respectively inserted by screws (not shown) for fastening the connecting portions 34 with the lateral boards 2. In other embodiments, the first positioning hole 121 can be a threaded hole, and the amount of the through holes 341 can be modified according to usage requirements.

Because the transverse portion 32 of the extended supporter 30 and the supporting portion 20 have the distance D therebetween, the user is prevented from the danger of being pinched between the transverse portion 32 and the supporting portion 20 when the supporting portion 20 located above the transverse portions 32 is swung downwardly relative to the base 10. For each extended supporter 30 of the supporting frame 1 of the electric bed, the transverse portion 32 is connected with the transverse pipe 12 of the base 10, and the connecting portion 34 is connected with the lateral board 2, so that the lateral boards 2 of the bed frame are unlike that of the prior art not movable relative to the electric bed. Therefore, the present disclosure can prevent the user from the danger of being pinched between the lateral board 2 and the electric bed, and also achieve the performance in overall styling. In particular, the lateral boards 2, the front board 3 and the rear board 4 can be covered by cushions, such as foams, so that the user can be prevented from getting hurt even when the user's limb is put between the lateral board 2 and the supporting portion 20.

Figure 4:
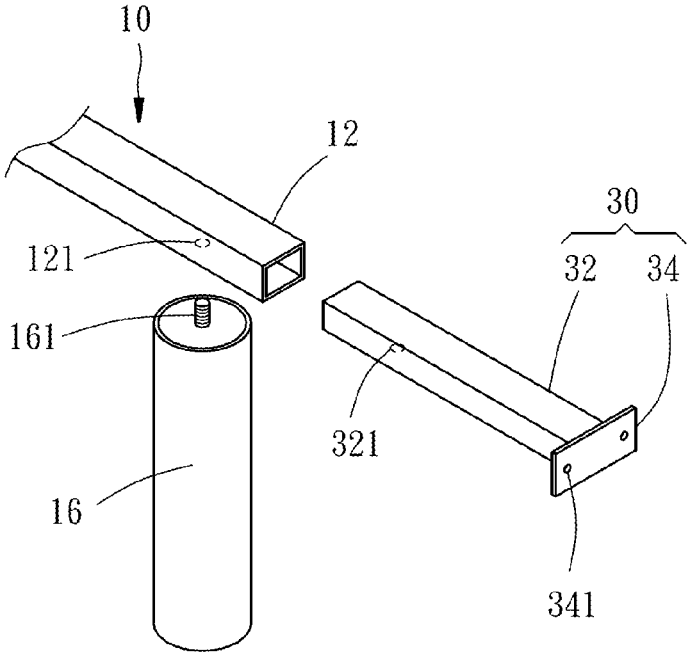
FIG. 4 is an exploded perspective view of a part of a second embodiment of the present disclosure.
Figure 5:
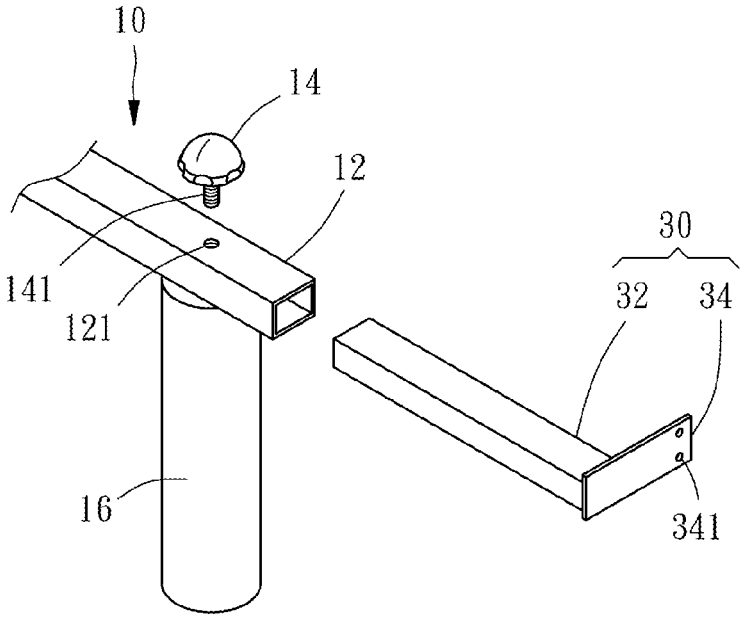
FIG. 5 is an exploded perspective view of a part of a third embodiment of the present disclosure.

In other embodiments, the connection of the base 10 and the extended supporter 30 can be implemented by variable manners. For example, the structures of the transverse portion 32 of the extended supporter 30 and the transverse pipe 12 of the base 10 can be exchanged, that is, the transverse portion 32 has an axial hole and is sleeved onto the transverse pipe 12 so that at least a part of the transverse pipe 12 is received in the transverse portion 32. Alternatively, the base 10 and the extended supporter 30 of the supporting frame 1 may be as that provided in the second embodiment of the present disclosure as shown in FIG. 4, wherein the first positioning hole 121 is located at the bottom of the transverse pipe 12, and the second positioning hole 321 is located at the bottom of the transverse portion 32 correspondingly to the first positioning hole 121. In this case, each support leg 16 may have a threaded rod 161 extended upwardly and inserted into the first positioning hole 121 and the second positioning hole 321. The first positioning hole 121 may be a through hole being passed by the threaded rod 161, and the second positioning hole 321 is a threaded hole being screwed with the threaded rod 161. In this structure, the support legs 16 are served as the positioning members 14 of the first embodiment. Alternatively, the base 10 and the extended supporter 30 of the supporting frame 1 may be as that provided in the third embodiment of the present disclosure as shown in FIG. 5, wherein the transverse portion 32 of the extended supporter 30 is not provided with such second positioning hole 321. In this case, the first positioning hole 121 of the transverse pipe 12 may be a threaded hole being screwed with the positioning member 14, and an end of the threaded rod 141 of the positioning member 14 is protruded out of the lower edge of the first positioning hole 121 and abutted against the top of the transverse portion 32, thereby restraining the transverse portion 32. In this embodiment, the connecting portion 34 of the extended supporter 30 and the transverse portion 32 are perpendicular with each other, so that the extended supporter 30 is L-shaped.

In addition to the aforesaid connecting manners, the base 10 and the extended supporter 30 may be connected by other manners according to the practical situation. For example, the positioning member 14 can be a pin being inserted into the first positioning hole 121 and the second positioning hole 321; in this case, the second positioning hole 321 may be not a threaded hole. The positioning member 14 is not limited to be screwed vertically, that is, upwardly or downwardly. For example, the positioning member 14 can be screwed with the extended supporter 30 horizontally, such as forwardly or backwardly, as long as the first positioning hole 121 or the second positioning hole 321 is located correspondingly to the positioning member 14. The transverse portion 32 of the extended supporter 30 can be engaged with the transverse pipe 12 by any well-known engaged structure, such as a spring in cooperation with a steel ball.

Figure 6:
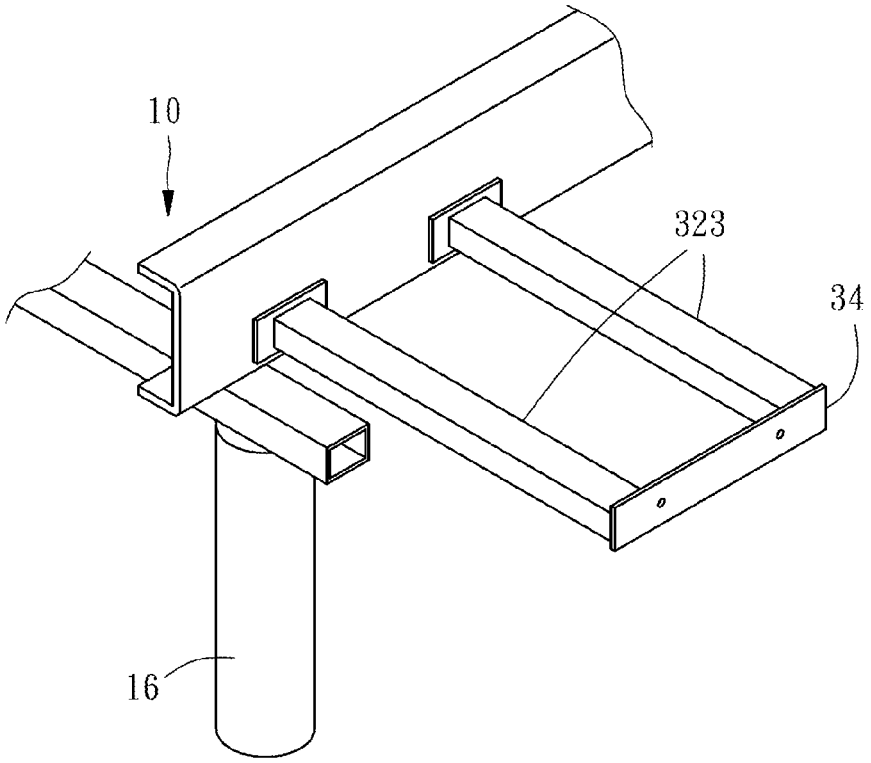
FIG. 6 is a perspective view of a part of a fourth embodiment of the present disclosure.

Referring to FIG. 6, the base 10 and the extended supporter 30 of the supporting frame 1 of a fourth embodiment of the present disclosure are difference from those of the aforesaid embodiments in that the base 10 and the extended supporter 30 of the fourth embodiment are connected directly by welding or soldering. In this embodiment, the transverse portion 32 of the extended supporter 30 has two supporting rods 323, and the connecting portion 34 is connected with the free ends of the two supporting rods 323, so that the extended supporter 30 is U-shaped.

The above description represents only the exemplary embodiments of the present disclosure, without any intention to limit the scope of the present disclosure thereto. Such structural variations or modifications not to be regarded as a departure from the spirit of the invention are intended to be included within the scope of the following claims of the present invention. For example, the shape or the amount of the extended supporter 30 can be modified.

What is claimed is:

1. A supporting frame of an electric bed, which is adapted to be connected with a lateral board, comprising: a base; a supporting portion disposed on the base, at least a part of the supporting portion being movable relative to the base, the lateral board being located adjacent to an edge of the supporting portion; and an extended supporter having a transverse portion extended from the base toward the lateral board and a connecting portion located at a free end of the transverse portion, wherein the transverse portion and the supporting portion have a distance therebetween, and the connecting portion is adapted to be connected with the lateral board; wherein the base has a transverse pipe sleeved onto the transverse portion of the extended supporter; wherein the transverse pipe has a first positioning hole, and a positioning member is inserted through the first positioning hole and abutted against the transverse portion of the extended supporter.

2. The supporting frame according to claim 1, wherein the connecting portion and the transverse portion of the extended supporter are perpendicular to each other, and the extended supporter is L-shaped.

* * * * *